United States Patent [19]

Forsberg

[11] 4,034,916

[45] July 12, 1977

[54] SINGLE STATION SPRAY SYSTEM

[75] Inventor: John R. Forsberg, Arlington Heights, Ill.

[73] Assignee: Helene Curtis Industries, Inc., Chicago, Ill.

[21] Appl. No.: 640,044

[22] Filed: Dec. 12, 1975

[51] Int. Cl.[2] ..... B05B 9/04

[52] U.S. Cl. ..... 239/373; 220/4 R; 248/359

[58] Field of Search ..... 239/373, 302, 337; 222/193, 333, 399; 220/4 R; 310/89, 91; 248/359

[56] References Cited

U.S. PATENT DOCUMENTS

| | | | |
|---|---|---|---|
| 2,465,042 | 3/1949 | Schlenker et al. | 310/89 |
| 2,518,566 | 8/1950 | Osterheld | 220/4 R |
| 2,552,420 | 5/1951 | Frankel | 220/4 R X |
| 2,639,904 | 5/1953 | McMaster et al. | 310/91 UX |
| 3,026,045 | 3/1962 | Reading | 239/373 X |
| 3,565,344 | 2/1971 | Takei et al. | 239/373 X |
| 3,705,689 | 12/1972 | Lee | 239/373 X |
| 3,752,404 | 8/1973 | Forsberg | 239/308 |

*Primary Examiner*—Evon C. Blunk
*Assistant Examiner*—Michael Mar
*Attorney, Agent, or Firm*—Dressler, Goldsmith, Clement, Gordon & Shore, Ltd.

[57] ABSTRACT

A single station air-liquid spray system wherein a replaceable liquid reservoir is provided in a housing, and an electric motor and compressor assembly is provided in the same housing. An air conduit is also positioned in the housing to supply air under pressure from the compressor to the reservoir, and a pair of conduits lead from the reservoir to a spray gun for supplying air and liquid, respectively, under pressure.

7 Claims, 2 Drawing Figures

SINGLE STATION SPRAY SYSTEM

BACKGROUND OF THE INVENTION

This invention relates to hair spray systems for use in the home or a beauty salon. More particularly, this invention relates to an air-liquid spray system which utilizes air under pressure as the propellant and thereby eliminates the use of so-called aerosol spray cans which pollute the air by discharge of propellant gases.

Most prior art air-liquid spray systems include three separate components which are connected by means of conduits. The first component is an electric motor and compressor assembly which supplies air under pressure through a conduit to a reservoir which is positioned in a second component. The flow of air into the reservoir forces air and liquid from the reservoir through conduits to a spray gun which comprises the third component of the system. An illustrative prior art patent is commonly assigned U.S. Pat. No. 3,752,404 to Forsberg which discloses an apparatus for feeding air and liquid under pressure to a plurality of spray guns.

In adapting the above-described Forsberg apparatus to a spray system using only a single spray gun, it has not heretofore been possible to place the reservoir and the electric motor and compressor in the same housing, while utilizing a reservoir which can be interchangeable with the reservoir used in a system employing a plurality of spray guns. Systems incorporating three separate components are of course more bulky and awkward to use than a more compact system wherein a spray gun is connected to a single housing which includes the electric motor and compressor and the reservoir.

SUMMARY OF THE INVENTION

In accordance with the present invention, a motor operated compressor of conventional type is mounted within a housing, and a replaceable liquid reservoir is receivable in the same housing, to provide a compact arrangement for providing air and liquid under pressure to a spray gun. Air is supplied under pressure from the compressor to the reservoir, and conduits connect the reservoir and spray gun for supplying air and liquid to the spray gun. The liquid in the reservoir may comprise hair spray liquid, and a water separator is not needed because water in the compressed air mingles with the aqueous hair spray liquid.

The hair spray liquid is supplied in a replaceable reservoir which is closed by a sealing plug which is not readily removable and has passages therethrough for the conduits. The spray gun includes a mixing chamber with spring biased valves at the ends, and includes a trigger with an adjustable stop so the operator can adjust the spray gun for the desired ratio of liquid to air and thereby deliver a heavy spray or various degrees of lighter spray. The spray system also includes an on-off switch for stopping the flow of air from the compressor to the reservoir.

The air-liquid spray system of the present invention is relatively compact because the electric motor and compressor assembly and the reservoir are provided in the same housing. The housing includes a base assembly and a cover member which is connected to the base assembly and is removable therefrom for replacing a spent reservoir with a full reservoir.

DETAILED DESCRIPTION OF THE PREFERRED EMBODIMENT

Figure 1:
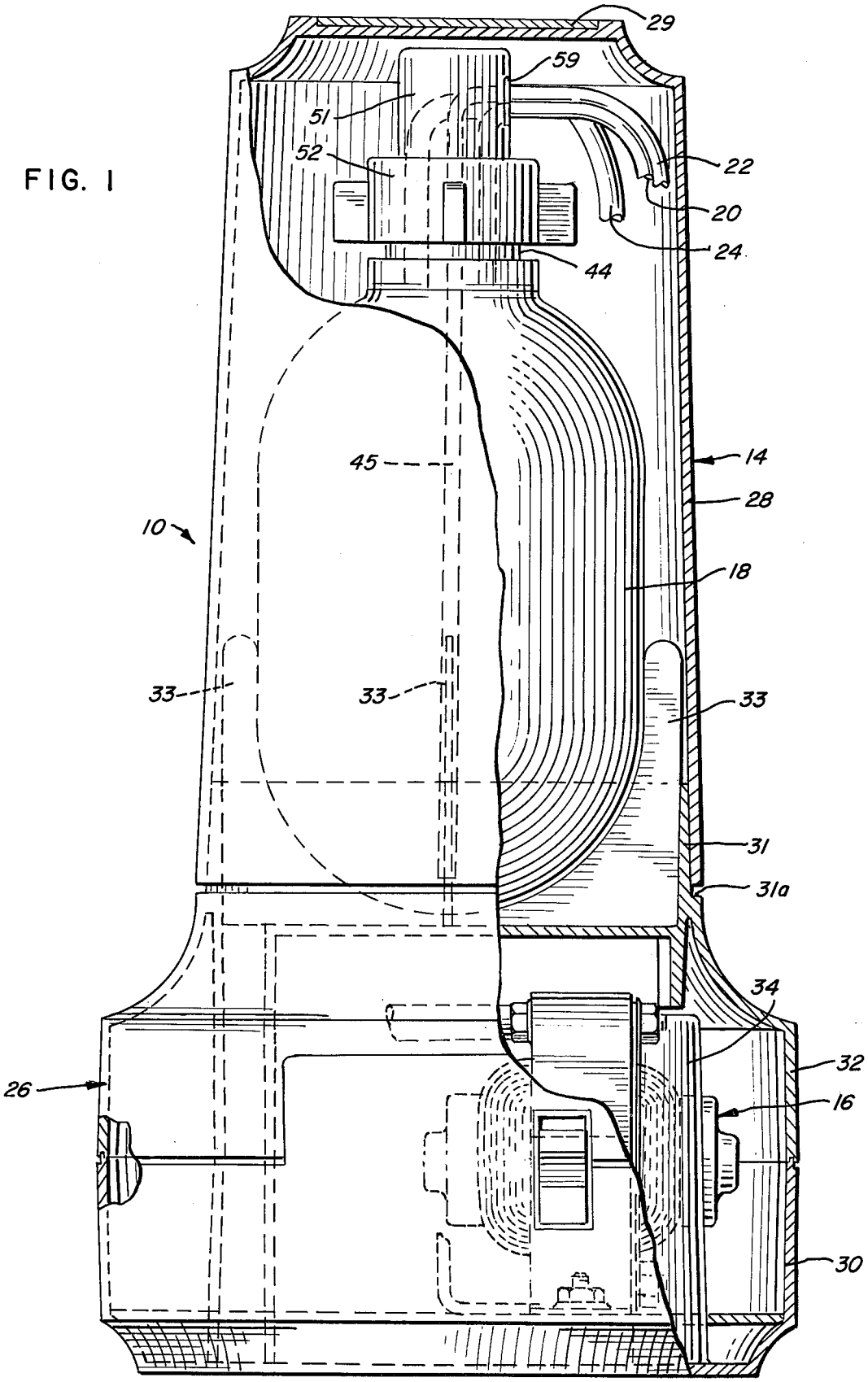
FIG. 1 is a front elevational view, partly broken away to show interior detail, of the air-liquid spray system in accordance with the present invention.

Referring to the drawings, there is shown an air-liquid spray system for transmitting air and liquid under pressure to a spray gun 12. Spray system 10 includes a housing 14 having a combined electric motor, compressor and limit control mechanism 16, a liquid reservoir 18 in the form of a flask, conduit 20 for conducting air under pressure and conduit 22 for conducting liquid under pressure from reservoir 18 to spray gun 12. Conduit 24 is provided within housing 14 for conducting compressed air from the air compressor to the reservoir flask 18. The flow of air and liquid and the mixing thereof to provide a spray is controlled by the spray gun 12. A spray gun suitable for use with the present invention is described in detail in commonly assigned U.S. Pat. No. 3,752,404 to Forsberg, which is incorporated herein by reference.

In accordance with the present invention, the compressor supplies air under pressure to liquid reservoir 18 via conduit 24. Unlike the prior art, the electric motor and compressor mechanism 16, liquid reservoir 18 and conduit 24 are all positioned within the same housing 14.

Figure 2:
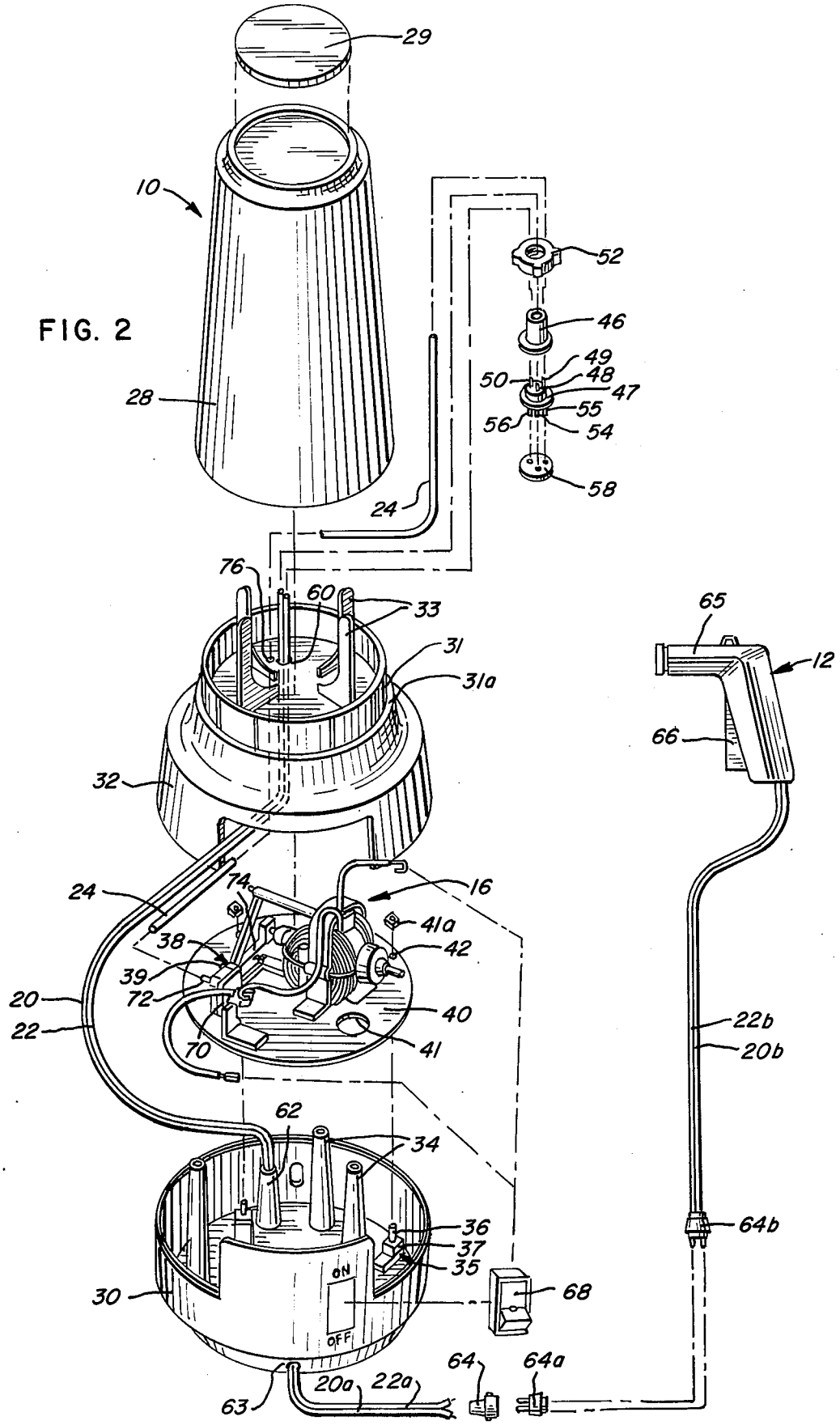
FIG. 2 is an exploded perspective view of the air-liquid spray system illustrated in FIG. 1.

As illustrated in FIGS. 1 and 2, housing 14 comprises a base assembly 26 and cover 28 which is removably connected to base assembly 26. The base assembly further includes a base member 30, and a body member 32 which is receivable on the base member and has a plurality of upstanding brackets 33 secured thereto for receiving and supporting the round bottom of reservoir 18. Body member 32 includes a reduced diameter portion 31 which can be tapered and defines a shoulder **31*a* between the reduced diameter portion and the remaining portion of the body member. Cover 28 is hollow and has an open end and an opposite closed end which can have a nameplate 29 secured thereto. The open end of cover 28 is receivable about reduced diameter portion 31, and shoulder 31*a* is a stop means to limit the insertion of cover 28. Base member 30 has a plurality of upwardly projecting lugs 34 and a plurality of support means 35. Each support means 35 may comprise an upstanding projection including a screw 36 having a nut 37** tightened thereon.

The electric motor, compressor and control mechanism 16 includes compressor 38 which is secured to a plate 40 that has a smaller diameter than base assembly 26 and is positioned therein. Plate 40 has openings 41 through which lugs 34 can be inserted, and openings 42 through which screws 36 can be inserted, to prevent relative rotational movement between plate 40 and base member 30. The lower surface of plate 40 rests on the upper surfaces of nuts 37 and can be secured to base member 30 by means of nuts **41*a* receivable on screws 36 to abut the upper surface of plate 40 and thereby prevent vertical displacement of plate 40 relative to base member 30. The electric driving motor and limit control mechanism is also secured to plate 40. Compressor 38 has a filter 39**, and the intake of the compressor passes through the filter. The control mechanism may be of the known type of pressure operated control mechanism which maintains the motor and compressor in continuous operation but opens a by-pass when the pressure reaches a predetermined value, thereby insuring a constant pressure air supply to the liquid reservoir 18.

As illustrated in FIG. 1, the liquid reservoir 18 is in the form of a flask or bottle provided with a neck 44 having an opening therein, and a plug 46 (FIG. 2) of plastic material which is received in the opening with a loose fit. The neck and plug may be arranged to cooperate as described in the aforementioned U.S. Pat. No. 3,752,404 to Forsberg to lock the plug against removal and against turning when the plug is pushed into the neck opening. Plug 46 has three apertures (not shown) extending longitudinally therethrough. One of the apertures is for the air supply from compressor 38 via conduit 24 and is somewhat larger than the other two apertures, which may be of equal diameter. The well for the aperture that communicates with conduit 24 receives a tube 45 (FIG. 1) which extends to adjacent the bottom of reservoir 18. Plug 46 receives coupling head 47 (FIGS. 1 and 2) having three passages therethrough corresponding to the apertures in plug 46, which passages are surrounded by integral sleeves 48, 49, 50 which extend outwardly from one end of the coupling head and are receivable in the apertures of plug 46. A flanged hollow cap 51 (FIG. 1) fits over a portion of coupling head 47, and a loose internally flanged coupling nut 52 receives the combined coupling head-cap unit. Coupling head 47 further includes sleeves 54, 55, 56 which extend outwardly from the opposite end thereof and are adapted to receive flexible conduits with a leak-proof fit, with closure gasket 58 fitting over sleeves 54, 55, 56. The conduits pass through aperture 59 in cap 51.

To assemble the device, coupling nut 52 is moved upwardly along cap 51 and the sleeves 48, 49, 50 in coupling head 47 are aligned with the three aperturs in plug 46. Coupling head 47 is then pushed down against the top of plug 46, with a suitable soft sealing gasket (not shown) being interposed therebetween. The exterior of the neck 44 of liquid reservoir 18 is threaded to fit the threads in nut 52. Upon screwing the nut 52, coupling head 47 and plug 46 are drawn down, causing the interposed ring gasket (not shown) to seat against the neck, and causing the lower face of the coupling head 47 and the interposed gasket to seat against the top surface of plug 46. The plug and sleeves 48, 49, 50 are thereby sealed against leakage from the liquid reservoir 18 to the exterior. Thus, air which enters liquid reservoir 18 from conduit 24 through plug 46 builds up pressure in the reservoir and the air bypasses over the surface of the liquid in the reservoir to supply air through conduit 20 to the spray gun 12. The air pressure in the reservoir forces liquid through tube 45 to conduit 22. Both liquid and air under pressure are thereby supplied to spray gun 12.

Conduits 20 and 22 pass downwardly from cap 51 outside reservoir 18 through housing 14, through opening 60 in body member 32, through a generally cylindrical hollow lug 62 which extends through a corresponding opening in plate 40, exits the housing through opening 63 in the base member 30, and passes on to spray gun 12. If desired, conduits 20 and 22 may include conduit segments 20*a* and 22*a* which are connected to a cap 64 and connector socket 64*a*, as shown in FIG. 2. A mating connector unit 64*b* is receivable in socket 64*a*, and conduit segments 20*b* and 22*b* lead from connector unit 64*b* to spray gun 12. This arrangement adds to the versatility of spray system 10 and enables different spray guns 12 to be connected to the spray system at different times.

A mixing chamber (not shown) is located in the barrel portion 65 of spray gun 12, and valve assemblies are positioned at opposite ends of the mixing chamber. The valve assemblies are arranged to be operated by the spray gun trigger 66 to open and close and thereby control the flow of air and liquid into the mixing chamber. As is also described in commonly assigned U.S. Pat. No. 3,752,404 to Forsberg, the trigger 66 may include an adjustable stop means so the operator can adjust the spray gun 12 for a desired ratio of liquid to air and thereby deliver a heavy spray or various degrees of lighter sprays.

When the liquid in reservoir 18 is depleted, it is possible to replace the empty reservoir by unscrewing nut 52 to allow removal of the coupling head 47 which is then attached to a full replacement reservoir as described hereinabove. This provides a convenient arrangement that saves the time that would be required to remove plug 46 and the connected conduits to refill the empty reservoir, and also avoids spillage.

On-off switch 68 is provided for stopping spray system 10 as desired, such as, for example, for changing reservoir 18. When switch 68 is moved to the off position, flow through conduit 24 is shut-off. Coupling head 47 can then be removed, the air trapped in reservoir 18 being let out as coupling head 47 is released, and reservoir 18 can be removed and replaced with a full replacement reservoir as previously described.

The electric motor and compressor mechanism 16 may be of the conventional type wherein air enters chamber 70 through an air intake and is forced outwardly under pressure through exit tube 72 by the reciprocating action of piston 74. Conduit 24 is connected at one end to exit tube 72, passes through an aperture 76 in body member 32 and is connected at the opposite end to plug 46. When switch 68 is in the on position, air is forced under pressure by the electric motor and compressor mechanism 16 into reservoir 18. A cord (not shown) exits through another aperture in base member 30 to connect switch 68 to an electrical outlet.

While this invention is susceptible of embodiment in many different forms, there is shown in the drawings and described herein in detail a preferred embodiment of the invention, with the understanding that the disclosure is to be considered as an exemplification of the principles of the invention and is not intended to limit the invention to the embodiment illustrated.

I claim:

1. An air-liquid spray system comprising: a housing having a base assembly and a cover member removably connected to said base assembly, said base assembly including a base member and a body member receivable on said base member, said cover member, base member, and body member being generally circular in cross-section; a generally circular plate member positioned in said base assembly; means for preventing said plate member from rotating relative to said base assembly; a compressor secured to said plate member and including air filter means; an electric driving motor for said compressor secured to said plate member whereby air supplied to the compressor passes through said filter means; a replaceable liquid reservoir receivable on said body member and within said cover member; a flexible air conduit positioned within said housing and removably connected to said compressor at one end and removably connected to said reservoir at the opposite end; and a spray gun operably connected to said reservoir by means of an air inlet conduit and a liquid inlet conduit, wherein said compressor, said driving motor and said reservoir are all positioned within said housing in a relatively compact arrangement for supplying air and liquid to said spray gun.

2. The air-liquid spray system as defined in claim 1 wherein said body member includes a reduced diameter portion and defines a shoulder between said reduced diameter portion and the remaining portion, whereby said cover member is receivable about said reduced diameter portion, and said shoulder is a stop means to limit the insertion of said cover member.

3. The air-liquid spray system as defined in claim 1, wherein said base member includes a plurality of upwardly projecting lugs and a plurality of upstanding support means, and said plate member has a plurality of apertures corresponding to said lugs, whereby said plate member is positioned on said support means with said lugs extending through said apertures to define said means for preventing said plate member from rotating relative to said base assembly.

4. The air-liquid spray system as defined in claim 3 wherein each of said support means comprises a screw having a first nut positioned thereon for supporting said plate member, and a second nut is positioned on said screw on the opposite side of said plate member for preventing vertical displacement of said plate member relative to said base member.

5. The air-liquid spray system as defined in claim 1 wherein said reservoir has a neck portion, plug means being receivable in said neck portion, said plug means having passageways for said air conduit to supply air from said compressor to said reservoir and for said air inlet conduit and said liquid inlet conduit to supply air and liquid, respectively, from said reservoir to said spray gun.

6. The air-liquid spray system as defined in claim 5 wherein said body member has apertures for said conduits and said base member has an aperture for said air inlet conduit and said liquid inlet conduit to pass to said spray gun.

7. The air-liquid spray system as defined in claim 1 wherein switch means is provided to start and stop the supply of air from said compressor to said reservoir.

* * * * *